US006280598B1

(12) United States Patent
Barton et al.

(10) Patent No.: US 6,280,598 B1
(45) Date of Patent: Aug. 28, 2001

(54) ANODIZATION OF MAGNESIUM AND MAGNESIUM BASED ALLOYS

(75) Inventors: Thomas Francis Barton, Boulder, CO (US); John Arnold Macculloch, Remuera; Philip Nicholas Ross, Taradale, both of (NZ)

(73) Assignee: Magnesium Technology Limited, Auckland (NZ)

( * ) Notice: Subject to any disclaimer, the term of this patent is extended or adjusted under 35 U.S.C. 154(b) by 0 days.

(21) Appl. No.: 09/118,576

(22) Filed: Jul. 17, 1998

Related U.S. Application Data

(63) Continuation-in-part of application No. 08/993,003, filed on Dec. 18, 1997, now abandoned, which is a continuation of application No. 08/595,354, filed on Feb. 1, 1996, now Pat. No. 5,792,335.

(30) Foreign Application Priority Data

Mar. 13, 1995 (NZ) ..... 270696

(51) Int. Cl.[7] ..... C25D 11/30
(52) U.S. Cl. ..... 205/210; 205/321
(58) Field of Search ..... 205/106, 107, 205/108, 316, 318, 321, 210

(56) References Cited

U.S. PATENT DOCUMENTS

| | | | |
|---|---|---|---|
| 2,305,669 | 12/1942 | Budiloff et al. | 205/318 |
| 2,901,409 | 8/1959 | De Long | 205/318 |
| 2,926,125 | 2/1960 | Currah et al. | 205/321 |
| 3,345,276 | 10/1967 | Munroe | 205/107 |
| 4,551,211 | 11/1985 | Kobayashi et al. | 205/199 |
| 4,978,432 | 12/1990 | Schmeling et al. | 205/108 |
| 5,385,662 | 1/1995 | Kurze et al. | 205/316 |

FOREIGN PATENT DOCUMENTS

| | | |
|---|---|---|
| 4104847 | 4/1993 | (DE) . |
| 2549092 | 5/1983 | (FR) . |
| 294237 | 9/1929 | (GB) . |
| 493935 | 10/1938 | (GB) . |

OTHER PUBLICATIONS

H. K. DeLong, "Practical Finishes for Magnesium", *Metal Progress*, 6/1970, vol. 97, No. 6, pp. 105–108.

Derwent Abstracts Accession No. 85–313716/50.

F.A. Lowenheim. *Electroplating*, McGraw–Hill Book Co., New York, pp 135, 1978 Month of publication not available.*

* cited by examiner

*Primary Examiner*—Kathryn Gorgos
*Assistant Examiner*—William T. Leader
(74) *Attorney, Agent, or Firm*—Brooks & Kushman P.C.

(57) ABSTRACT

This invention provides a method for the anodization of magnesium or magnesium based alloys using an electrolytic solution containing ammonia, amines or both. The use of such an aqueous electrolytic solution in at least preferred forms alters the conditions under which anodization can occur to provide a more than satisfactory coating on the magnesium material with reduced cycle times.

17 Claims, 1 Drawing Sheet

ANODIZATION OF MAGNESIUM AND MAGNESIUM BASED ALLOYS

CROSS REFERENCE TO RELATED APPLICATION

This is a continuation-in-part of application Ser. No. 08/993,003, filed Dec. 18, 1997, now abondoned, which is a continuation of application Ser. No. 08/595,354 filed Feb. 1, 1996, now U.S. Pat. No. 5,792,355.

FIELD OF THE INVENTION

This invention relates to a method for the anodization of magnesium and magnesium based alloys and products produced by that method.

DESCRIPTION OF THE PRIOR ART

A major component of the building industry and, in particular, although not solely, the metal joinery industry has been aluminum based products. Although the price of aluminum has increased in recent years, it is still the principal material of many components due to its strength, weight and the finishes available to aluminum.

By contrast, magnesium prices has remained relatively stable and is not a serious competitor to aluminum. It exhibits similar properties in terms of strength and weight. In the case of both aluminum and magnesium, these materials require some form of corrosion resistant and wear resistant coatings. Both materials easily discolor upon exposure to the atmosphere through oxidization.

The anodization of aluminum is a relatively easy procedure compared with the equivalent anodization of magnesium. It is for this reason that the aluminum has been preferred despite the rising price. Therefore, an advantage exists for magnesium should the anodization process be simplified to allow this material to compete equally with aluminum in a number of applications.

Previous attempts to anodize magnesium have involved the use of base solutions of concentrated alkaline hydroxides. These usually take the form of sodium or potassium hydroxides in a concentrated solution. This anodization process is generally provided through the supply of a DC current at a range of 50 volts to 150 volts. Some methods have suggested the use of AC current as well.

A coating is formed on the magnesium through the formation of sparks within the bath containing the sodium or potassium hydroxide. The tracking of the sparks across the surface of the magnesium element slowly places the coating onto the magnesium. The use of sparks throughout the process leads to a relatively high current usage and to significant heat absorption by the bath itself. Therefore, any commercial anodization plant requires substantial cooling equipment to reduce the temperature of the bath through the use of this process.

The coating formed by this anodization process is an opaque coating with a white or gray color. However, the coating is not a direct visual comparison with anodized aluminum and, therefore, has a problem matching other components made from anodized aluminum. This leads most manufacturers only to use aluminum throughout their manufacture.

Some prior art processes use hydrofluoric acid or acid fluoride salts in which magnesium is not attacked because of the formation of a protective layer of magnesium fluoride on the metal surface. This protective layer is not soluble in water and thus prevents further attack.

A further method of anodizing magnesium or alloys of magnesium relies on this property to create a rough, very porous layer which forms an excellent base for paint or other surface coatings to be applied afterwards. Commonly, such an anodic film may be formed in an electrolyte of very high pH, containing alkali hydroxides. The process proceeds by means of sparking which sparking forms a sintered ceramic oxide film as the metal substrate is coated.

A number of proprietary methods for anodization of magnesium or alloys of magnesium exist which seek to avoid this problem and create a uniform film. This can only be done by incorporating other species into the film as it is formed. Some processes use silicates. Others use various ceramic materials. Some of these processes involve the use of hydrofluoric acid or acid fluoride salts, eg; ammonium bifluoride. These are extremely hazardous materials causing fume and safety problems to the plant operators, and disposal problems. The process may be carried out on a magnesium based material which preferably contains magnesium in the range of 70% to 100% by weight.

OBJECT OF THE INVENTION

Therefore, it is an object of the present invention to provide a method for the anodization of magnesium or magnesium alloys which will provide a coating similar to anodized aluminum, add corrosion resistance and/or overcome some of the disadvantages of the prior art and/or at least provide the public with a useful choice.

SUMMARY OF THE INVENTION

The invention may broadly be said to consist in a method for the anodization of magnesium based materials comprising:

providing an electrolytic solution containing ammonia and/or an amine;

providing a cathode in said solution;

placing magnesium based material as an anode in said solution; and passing a current between the anode and cathode through said solution so that a coating is formed on said material.

Another aspect of the invention consists of a material containing magnesium, anodized by the method previously defined.

Further aspects of this invention may become apparent to those skilled in the art to which the invention relates upon reading the following description.

BRIEF DESCRIPTION OF THE DRAWINGS

Description of the preferred embodiments of the invention will now be provided with reference to the drawings in which.

DETAILED DESCRIPTION OF THE PREFERRED EMBODIMENTS

Figure 1:
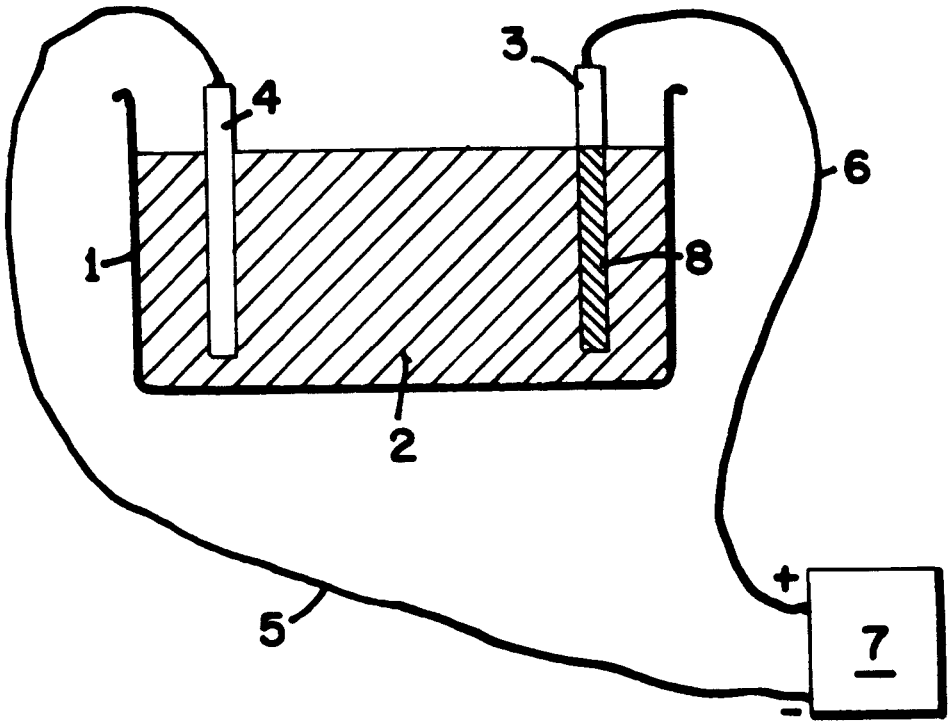
FIG. 1 shows a diagrammatic view of an anodization bath in accordance with an embodiment of this invention.

This invention provides a method for the anodization of magnesium containing material such as magnesium itself or its alloys. The process has been found to be useful on substantially pure magnesium samples as well as magnesium alloys such as AZ91 and AM60 which are common magnesium alloys used in casting.

For purposes of the present invention, magnesium containing material includes magnesium, a magnesium alloy, or an alloy containing magnesium, e.g. an aluminum alloy low in magnesium content.

The numbers hereinafter in bold refer to the numbers in FIG. 1.

The process of this invention utilizes a bath 1 having a solution 2 into which the magnesium containing material 3 may be at least partially immersed.

Electrodes 3 and 4 are provided in the bath 1 and into the solution 2, the solution 2 being an electrolytic solution.

Suitable connections such as cables 5 and 6 are provided from the electrodes 3 and 4 to a power supply 7.

The solution 2 is provided to include ammonia and/or amine to a suitable concentration. The concentration of the ammonia and/or amine in the electrolytic solution 2 may vary, however, a preferred range of between 1% and 33% w/v is desirable. It has been found that solutions in which the concentration of ammonia and/or amine is below 1% w/v tends to cause some sparks to form with the method of formation of the coating tending more towards a coating formed through spark formation similar to prior art methods of anodization. A 33% maximum concentration of ammonia and/or amine acts as an upper limit.

In the preferred forms of the invention, the ammonia and/or amine concentration has been found to work suitably in the region of 5 to 10% w/v or, more preferably, 5 to 7% w/v.

A current from the power supply 7 is passed through suitable connections such as cables 5 and 6 to the electrodes 3 and 4 immersed within the electrolytic solution 2. In this example, the process of formation of the coating generally occurs when the voltage reaches the approximate range of 220 to 250 V DC. It should be noted that the prior art anodization processes occur between 50 and 150 V DC and, therefore, a reduction of the concentration of ammonia and/or amine below the desired level tends to allow sparks to form through the process taking up the properties of the prior art alkaline hydroxide anodization processes before the voltage can reach a level suitable to form the coating in accordance with the present invention. Other embodiments can allow within the approximate range of 170 to 350 v DC.

In a process such as this embodiment, the formation of sparks can occur for a number of reasons. The ammonia acts to repress sparks generally, but the concentration of salts in the bath also has an effect. If the ammonia and/or amine gets too low, sparks may form. If the concentration of phosphate is increased greatly, sparks may occur at higher voltages, though the coating may form completely before the voltages increased to such a voltage. For example, in a solution of 5% ammonia and 0.05M sodium ammonium hydrogen phosphate, the coating is formed between 220 and 250 V DC without any significant spark formation. The coating that results is a protective coating and semi-transparent. If the voltage is increased to 300 V DC, the coating is thicker and become opaque, and still no sparks occur in the formation process.

By contrast, a solution of 5% ammonia and 0.2M sodium ammonium hydrogen phosphate, the coating forms between 170 and 200 V DC. Attempts to increase the voltage significantly above 200 V DC may produce sparks.

In a further example, a solution with 3% ammonia and 0.05M sodium ammonium hydrogen phosphate was tried. Sparks occurred at, approximately 140 V DC and this is prior to a good coating having been formed on the magnesium anode.

In a further embodiment, peroxide may be added to the electrolytic solution. The addition of peroxide, such as sodium peroxide or hydrogen peroxide, has been observed to decrease the voltage at which the coating forms without spark formation. For example, a solution of 5% ammonia, 0.05M sodium ammonium hydrogen phosphate and 0.1M sodium peroxide produces a coating at 210 V DC very similar to a 300 V DC coating formed in the absence of the peroxide. This may be advantageous in circumstances where a lower operating voltage is desired.

It has been further observed that decreasing the level of peroxide to 0.05M produces no significant difference to the coating than the example with no peroxide. Further, increasing the peroxide to 0.2M appears to prevent any reasonable coating being formed due to the presence of damaging sparks.

On this basis, a further preferred embodiment in which peroxide is added at, approximately, 0.1M may allow lower operating voltages if desired.

Upon application of the current to the electrolytic solution 2, a coating forms on the material 3 forming the anode on that portion 8 of the material 3 which is immersed within the solution 2. The process itself is, to a large degree, self terminating with the current drawn by the anodizing bath 1 falling off as the depth of coating on the portion 8 increases. In this manner, the placement of an article 3 as an anode within the anodizing bath 1 tends to draw current until the coating is formed and when sufficient coating exists to substantially isolate the magnesium in the material 3 from the electrolytic solution 2, the current drawn falls and can act as an indicator that the coating has been applied.

A number of additives may be provided in the solution 2 to alter the final coating and its appearance. For example, phosphate compounds may be used to provide a finish similar to anodized aluminum and it has been found that phosphate compounds, such as phosphoric acid, soluble phosphate salts or soluble ammonium phosphate, provided in the range of 0.01 to 0.2 molar can be suitable. Generally a concentration less than 0.01 tends to provide finish which is somewhat too transparent to suitably be compared with anodized aluminum. Similarly, concentrations greater than 0.2 lead to an opaque finish which again alters from the appearance of anodized aluminum. A preferred range of 0.05 to 0.15 molar of a phosphate compound such as ammonium sodium hydrogen phosphate has been found to be suitable if it is desired to provide a finish similar in appearance to anodized aluminum. The ammonium phosphate has been found particularly useful and other ammonium phosphate compounds could act as direct substitutes.

Anodization using the ammonium phosphate compounds gives significant corrosion resistance to the coating. Also the coating is particularly suited to further coating with paint or other organic sealers.

In further preferred forms of the invention, the electrolytic solution 2 may contain compounds such as ammonium dihydrogen phosphate, or alternatively or additionally, diammonium hydrogen phosphate. Both of these compounds may be more readily available in commercial quantities for the anodization process compared with compounds such as ammonium sodium hydrogen phosphate.

An alternative additive to provide a finish similar to anodized aluminum has been found to be the use of fluoride and aluminate in similar concentrations to the phosphate compounds. Typical concentrations of compounds such as sodium aluminate and sodium fluoride are 0.05 molar of each of these compounds. As the concentration of sodium aluminate and sodium fluoride is increased towards 0.1 molar, the finish changes to a pearl colored finish. Although this may be aesthetically pleasing in itself, it is not directly comparable with the anodized aluminum finish and, therefore, may be less suitable if it is desired to manufacture components of the same joinery from the different materials and be able to provide matching finishes on both aluminum and magnesium products.

The process itself is conducted at relatively low currents compared with the previous anodization of magnesium processes. The current drawn is in the order of 0.01 amps per square centimeter of magnesium surface. The low current and lack of spark formation lead to a decrease in the temperature rise within the bath 1 to form an equivalent depth of coating compared with the alkaline hydroxide baths used previously. This reduction in the temperature rise of the bath leads to a significant decrease in the cooling equipment necessary to conduct the process.

Current preferred forms of the invention have been conducted at room temperature and it is preferred, although not essential, to conduct the anodization process at less than 50° C.

If alternative finishes are required and the production of a finish similar to the anodized aluminum is not necessarily required, a variety of coloring agents could be added to the solution. The anodization process would still provide corrosion resistance and act as an alternative to powder coating of such components.

It should be noted that the choice of additives includes a phosphate additive and/or a fluoride additive. If the fluoride additive is used in substitution for the phosphate additive, this leads to greater problems with the disposal of the solution. Fluoride compounds themselves are not particularly environmentally sensitive. Fluoride compounds are environmentally costly owing to stringent environmental regulation of their effluent and disposal. By comparison, the phosphate compounds are less damaging to the environment and may be preferred for this reason alone.

The additives may also include sealants, foaming agents or other compounds and many of the additives used in the previous anodization processes such as aluminates, silicates, borates, fluorida, phosphate, citrate and phenol may be used.

The coating formed on the magnesium is a mixed coating of magnesium oxide and magnesium hydroxide with further constituents according to any particular additives used in the process. For example, the embodiment in which sodium ammonium hydrogen phosphate is provided leads to a magnesium phosphate component in the coating. Further, the embodiment in which fluoride and aluminate compounds are provided may lead to the presence of magnesium fluoride and magnesium aluminate in the finished coating.

It should further be noted that the use of ammonia in the solution may necessitate the use of ventilation in the area about the anodization bath 1.

The process as defined also tends to provide the coating somewhat faster than the prior use of alkaline hydroxide solutions.

A preferred electrolyte composition is:

ammonia—3.0–3.3 molar* (usually made up from 25% aqueous solution);

phosphoric acid—0.1–0.2 molar (alternatively a phosphate salt may be used); and a foaming agent—0.1 ml per liter of a non-ionic foaming agent.

This bath has a pH of approximately 11.6.

*The ammonia concentration is 3.0 to 3.3 molar after the addition of the phosphoric acid, hence the ammonia added initially to the bath is slightly more than this.

The foaming agent ideally has the effect of reducing ammonia loss to the atmosphere.

The preferred electrochemical conditions for anodization with such a composition comprise:

(I)(i) DC Voltage endpoint—350V to 500V depending on desired film thickness; and optionally:

(ii)(a) AC Voltage set point—zero to 40V; and/or (ii)(b) Pulsed Voltage set point—zero to 40V; and (II) Bulk DC current density—150–400 amps per square meter.

The temperature is in the range from 0° C. to 35° C. (most preferably 10–30° C.).

The present invention also includes the finding that the use of ammonia may be partially or completely substituted by an amine. Simple amines, such as methyl or ethyl amine are volatile so it is recommended that any substitution involve a longer chain or more complex amine. Suitable amines are water soluble primary, secondary, or tertiary alkyl or allyl amines having three or more carbon atoms and a pKa greater than 5 and preferably greater than 9. Suitable amines must be water soluble at least to a level of 3.0 molar and should feature basicity similar to that of ammonia (ability to form hydroxyl, OH- ions in solution). Also, suitable amines are capable of expressing ammonia gas or a volatile amine moiety. Some examples of amines that may be used are diethylene triamine and ethanolamine. Preferably, the ammonia and/or amine concentration is 0.4 to 12 molar.

The anodizing voltage may preferably be from 250V DC upwards, with AC voltage imposed additionally as may be required. When hydrogen peroxide is not present in the electrolyte solution, the voltage range is greater than 300 volts and less than 600 volts DC. When hydrogen peroxide is present in the electrolyte solution, the voltage range is greater than 280 volts and less than 550 volts DC. It is preferred that the electrolyte solution be free of any substantial presence of chromium (III) and chromium (VI). It is also preferred that the electrolyte solution contain no alkali salt yielding hydroxide ions upon hydrolysis. Where the electrolyte solution contains ammonia and no amine, the anodization current is at least 350 volts DC. Where the electrolyte solution contains an amine or ammonia and an amine, the anodization current is at least 250 volts DC. The magnesium or magnesium alloy may be anodised using an AC voltage or pulsed, square wave form voltage, between zero and 40. The material is anodised using a current density from 50 to 1000 amps per square meter, preferably from 200 to 350 amps per square meter.

The magnesium or magnesium alloy article is preferably cleaned prior to anodization. The cleaning pre-treatment step includes at least one of the following:

(A) immersion of the article in a mixture of sodium tetraborate and sodium pyrophosphate solution at 70° C. to 90° C. for approximately at least five minutes;

(B) immersion of the article in 35% hydrofluoric acid (v/v) at ambient temperature for at least approximately one minute; or (C) immersion of the article in a one to one mixture of 35% hydrofluoric acid (w/w) and 68% nitric acid (w/v) for at least approximately one minute.

A preferred electrolyte composition is:

ammonia—2.5%;

diethylene triamine—0.5 molar phosphoric acid—0.1–0.2 molar (alternatively a phosphate salt may be used); and a foaming agent—0.1ml per liter of a non-ionic foaming agent.

This bath has a pH above 7.

The foaming agent ideally has the effect of reducing ammonia loss to the atmosphere.

The preferred electrochemical conditions for anodization with such a composition comprise:

(I)(i) DC Voltage endpoint—250V to 500V depending on desired film thickness; and optionally:

(ii)(a) AC Voltage set point—zero to 40V; and/or (ii)(b) Pulsed Voltage set point—zero to 40V; and (II) Bulk DC current density—200–350 amps per square meter.

The temperature is below 50° C.

Thus it can be seen that the process and the products from the process may provide significant advantages over the prior art methods and products.

Wherein the forgoing description, reference has been made to specific components or integers of the invention having known equivalents, then such equivalents are herein incorporated as if individually set forth.

Although this invention has been described by way of example and with reference to possible embodiments thereof, it is to be understood that modifications or improvements may be made thereto without departing from the scope or spirit of the invention.

EXAMPLE 1

An AZ91D magnesium plate was pre-cleaned in a solution containing 0.2 molar sodium tetraborate and 0.07 molar sodium pyrophosphate. This was then anodised in an electrolyte comprising 4.9% ammonia (expressed as w/v $NH_3$) and 0.2 molar diammonium hydrogen phosphate at a voltage that peaked at 400V DC at a bulk current density of 200 amps per square meter. After attainment of 400V, which took just over seven minutes, the power supply was cut off and an anodic film of 9 microns was observed on the sample. Total cycle time was 7 minutes.

EXAMPLE 2

An AM50 magnesium component was anodised at 100 amps per square meter, up to an endpoint voltage of 350V DC. The electrolyte composition was 3% ammonia (expressed as w/v ammonia gas) and 0.2 molar diammonium hydrogen phosphate. The component received a rinse prior to anodization but no other pre-treatment. Upon attainment of the endpoint voltage, the power was maintained to the sample and held at 350V DC for approximately ten minutes. Upon rinsing the sample was found to have an anodic film of approximately 17 microns. The cycle time was approximately 30 minutes.

EXAMPLE 3

An AZ91D magnesium plate was anodised in an electrolyte comprising ammonia at 8% concentration (w/v as ammonia gas) and phosphoric acid at 0.1 molar. The sample was pre-cleaned in a bath comprising 0.2 molar sodium tetraborate and 0.07 molar sodium pyrophosphate at 60EC for five minutes, then it was activated in a bath comprising 35% hydrofluoric acid (v/v) for one minute prior to anodization. The anodization was conducted at 200 amps per square meter, using a DC power supply that attained 465V which was then held for five minutes. A coating of 21.8 microns resulted. The anodizing cycle required a total of 26 minutes.

EXMAPLE 4

An AZ91D magnesium plate was anodised in an electrolyte comprising ammonia at 5.0% (expressed w/v as ammonia gas), 0.1 molar phosphoric acid and 0.03 molar hydrogen peroxide. The plate was pre-cleaned as per example #3 above and activated as per example #3 above. It was then anodised using a power supply comprising a DC voltage that reached 385V, and an AC voltage which reached 52V. The DC current density was 280 amps per square meter while the AC current density peaked at 90 amps per square meter. The DC endpoint voltage was held for five minutes, then the sample was post-treated for two minutes in a bath containing 1.0 molar sodium dihydrogen phosphate at 60EC. The sample was found to have an anodic coating of 19.7 microns. The anodizing cycle required a total time of 15 minutes.

EXAMPLE 5

An AZ91D test plate was pre-cleaned in a bath comprising 0.2 molar sodium tetraborate and 0.07 molar sodium pyrophosphate as in example #3 above. It was then anodised in an electrolyte comprising 2.5% ammonia (expressed as ammonia gas) and 0.5 molar diethylene triamine (DETA), together with phosphoric acid at 0.1 molar, at a DC voltage that attained 360V which was held for five minutes. The current density was 200 amps per square meter. The plate was found to have an anodic coating of 28.2 microns. The total cycle time was 21 minutes for the anodizing process.

EXAMPLE 6

An AZ91D test plate was pre-cleaned in the mixture described in example #3 (but not activated). It was then anodized in a solution comprising 19.8% monoethanolamine (w/v) and 0.2 molar sodium dihydrogen phosphate at a DC voltage that attained 350V which was held for five minutes. The current density was 200 amps per square meter. The sample was found to have an anodic coating of 20.2 microns. The total anodizing cycle time was 16 minutes 30 seconds.

Note: in the above examples, process times quoted represent anodizing times, not including pre-cleaning or activation where these are specified, nor any post-anodization treatments.

We claim:

1. A method for the anodization of magnesium based materials comprising:

a first pre-treatment step including at least one of the following:

(A) immersion of the material in a mixture of sodium tetraborate and sodium pyrophosphate solution at 70° C. to 90° C. for approximately at least five minutes;

(B) immersion of the material in 35% hydrofluoric acid v/v at ambient temperature for at least approximately one minute; or (C) immersion of the material in a one to one mixture of 35% hydrofluoric acid w/w and 68% nitric acid w/v for at least approximately one minutes;

providing an electrolytic solution comprising 1% to 33% w/v of ammonia, an amine, or a mixture thereof;

providing a cathode in said solution;

placing the magnesium based material as an anode in said solution; and passing a current between the anode and cathode through said solution so that a coating is formed on said material.

2. The method of claim 1 wherein said magnesium based materials contain magnesium in the range of 70% to 100% by weight.

3. The method of claim 1 wherein said ammonia, amine or mixture thereof is provided in said solution in the range of 5% to 10% w/v.

4. The method of claim 1 wherein said current is provided by a DC supply having a potential in the range of 170 to 500 V DC.

5. The method of claim 1 wherein said electrolyte solution includes a phosphate compound provided in the range of 0.01 to 0.2 molar.

6. The method of claim 5 wherein said phosphate compound comprises a sodium hydrogen phosphate.

7. The method of claim 5 wherein said electrolytic solution contains ammonium sodium hydrogen phosphate.

8. The method of claim 5 wherein said electrolytic solution contains ammonium dihydrogen phosphate.

9. The method of claim 5 wherein said electrolytic solution includes diammonium hydrogen phosphate.

10. The method of claim 1 wherein said electrolytic solution comprises fluoride compounds, aluminate compounds or mixtures thereof.

11. A method for the anodization of magnesium as claimed in claim 10 wherein said fluoride and aluminate compounds are each provided in the range of 0.01 to 0.2 molar.

12. A method for the anodization of magnesium as claimed in claim 11 wherein said fluoride and aluminate compounds comprise sodium aluminate and sodium fluoride and are each provided in the range of 0.05 to 0.1 molar.

13. The method of claim 1 wherein said electrolytic solution contains peroxide.

14. The method of claim 13 wherein said peroxide is provided in the range of 0.05 to 0.2 molar.

15. The method of claim 14 wherein said peroxide comprises sodium peroxide or hydrogen peroxide.

16. The method of claim 1 wherein said amine is a water soluble primary, secondary, or tertiary alkyl or allyl amine having three or more carbon atoms.

17. The method of claim 1 wherein said amine is diethylene triamine or ethanolamine.

* * * * *